US006116653A

United States Patent [19]

Oberholzer et al.

[11] Patent Number: 6,116,653

[45] **Date of Patent: *Sep. 12, 2000**

[54] PRINTABLE TAG WITH INTEGRAL LOOP FASTENER

[75] Inventors: John Carson Oberholzer, Brighton, Mich.; Kevin Charles Lacek, River Falls, Wis.

[73] Assignee: Lowry Computer Products, Inc., Brighton, Mich.

[ * ] Notice: This patent issued on a continued prosecution application filed under 37 CFR 1.53(d), and is subject to the twenty year patent term provisions of 35 U.S.C. 154(a)(2).

[21] Appl. No.: 09/257,456

[22] Filed: Feb. 25, 1999

[51] Int. Cl.[7] ..... B24D 15/00

[52] U.S. Cl. ..... 283/74; 283/101; 283/79; 40/299.01

[58] Field of Search ..... 283/74, 79, 80; 40/299, 673, 299.01

[56] References Cited

U.S. PATENT DOCUMENTS

| | | | |
|---|---|---|---|
| 281,733 | 7/1883 | Sears . | |
| 428,465 | 5/1890 | Crump . | |
| 891,593 | 6/1908 | Conrad et al. . | |
| 3,546,798 | 12/1970 | Rethmeier | 40/673 |
| 4,577,426 | 3/1986 | Jenkins | 40/21 R |
| 5,104,148 | 4/1992 | Neal . | |
| 5,151,403 | 9/1992 | Suzuki et al. . | |
| 5,271,642 | 12/1993 | Jahier et al. . | |
| 5,343,647 | 9/1994 | Bulka | 283/101 |
| 5,378,515 | 1/1995 | Hatton | 428/40 |
| 5,381,617 | 1/1995 | Schwartztol et al. | 40/299 |
| 5,484,168 | 1/1996 | Chigot | 283/67 |
| 5,538,289 | 7/1996 | Cassis, III . | |
| 5,560,657 | 10/1996 | Morgan | 283/80 |
| 5,627,656 | 5/1997 | Ludlow et al. | 40/299 |
| 5,673,943 | 10/1997 | Campbell . | |
| 5,782,496 | 7/1998 | Casper et al. | 283/81 |
| 5,816,620 | 10/1998 | Buell | 283/74 |

OTHER PUBLICATIONS

Sales brochure from Economy Label Sales regarding Plant Nursery Tags for identifying plants.

*Primary Examiner*—Willmon Fridie, Jr.
*Assistant Examiner*—Aeisif Thurston
*Attorney, Agent, or Firm*—Harness, Dickey & Pierce, P.L.C.

[57] ABSTRACT

The printable substrate of biaxially multi-layered laminate material is perforated to define an integral loop structure having a slotted opening to receive the tag body and thereby secure the tag to an article. An additional perforation defines an optional, removable index card that may be printed upon when the tag itself is printed. The tag substrate may be provided as a continuous web that has been perforated to define multiple tags, suitable for printing and dispensing by automated mechanism.

10 Claims, 4 Drawing Sheets

PRINTABLE TAG WITH INTEGRAL LOOP FASTENER

BACKGROUND AND SUMMARY OF THE INVENTION

The present invention relates generally to tags and labels. More particularly, the invention relates to a printable tag with integral loop fastener suitable for being printed and dispensed by mechanical means. The integral loop fastener allows the tag to be quickly attached to goods, shipping containers or dunnage, without the need to install a separate string or wire fastener.

Shipping tags and labels are used throughout industry for inventory control, shipping origin and destination addressing, component identification, just-in-time manufacturing, specimen labeling, and the like. Traditionally, most industries have used a simple paper tag with separate wire or string fastener, designed to be written on by hand and then attached to the article. Although this paper tag can be printed on and dispensed mechanically, the wire or string fastener must be installed separately so as not to jam the feeding and printing apparatus.

With the prevalence of many inventory management systems, process flow control systems and shipping systems now operating under computer control, there is considerable interest in a printable tag that works in this automated environment. Desirably, the tag should be printed and dispensed as part of the automated manufacturing, shipping and/or storage process, with the tag being ready for immediate application to the article. In this way, accurate correlation between the tag and the article is ensured and the manufacturing, shipping and/or storage process proceeds efficiently.

To meet the needs of today's automated environments, the invention provides a printable tag with integral loop fastener that requires no separate string or wire fastener. The tag employs a printable substrate that is provided with a first perforation which separates to define an elongated loop structure. A second perforation, extending laterally adjacent to one edge of the substrate, separates to define an elongated slotted opening in the loop structure. The opening is sized to allow the tag body to be passed through it.

In use, the tag is applied by breaking the perforations through a quick zipping action, to free the loop structure while leaving one end of the loop structure attached to the substrate. The loop structure is then wrapped or looped around the article to be tagged, and the free end of the tag body is inserted into the slotted opening and pulled tight.

The presently preferred tag is a biaxially multi-layered laminate of polyethylene with a matte top coating to support printing by suitable thermal printer or laser printer.

For a more complete understanding of the invention, its objects and advantages, refer to the following specification and to the accompanying drawings.

DESCRIPTION OF THE PREFERRED EMBODIMENTS

Figure 1:
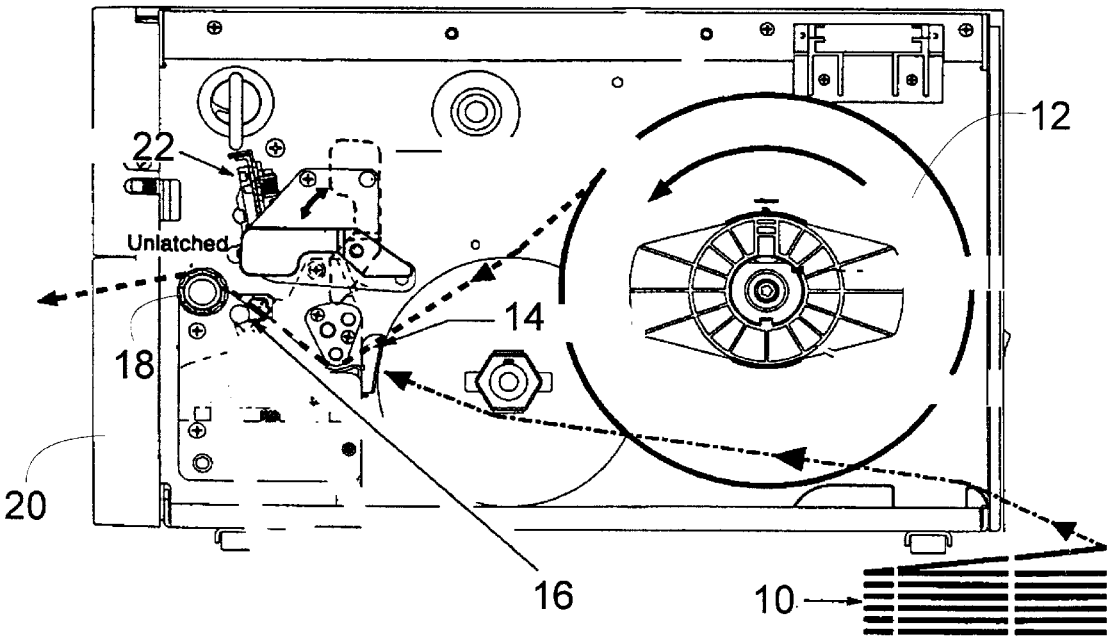
FIG. 1 is a cross-sectional view of an exemplary printing and labeling apparatus useful in understanding how the printable tag of the invention may be deployed.

The printable tag of the invention may be deployed manually or by mechanized printing and dispensing apparatus. Such apparatus is illustrated in FIG. 1, in which the printable tag of the invention is illustrated in fanfold form at 10 and in roll form at 12. In both forms the tag stock comprises a perforated web of tags arranged end-to-end.

Whether provided in fanfold form or roll form, the tag media is fed through the printing and dispensing mechanism as illustrated by the broken lines in FIG. 1. Specifically, the tag media is passed through media guide 14, past the media edge sensor 16, around the capstan 18 and out through the front of the dispensing mechanism 20. The dispensing mechanism can be provided with a print mechanism or print head 22 that applies printed information, such as alphanumeric text or barcode information to the printable surface of the tag substrate.

Figure 2:
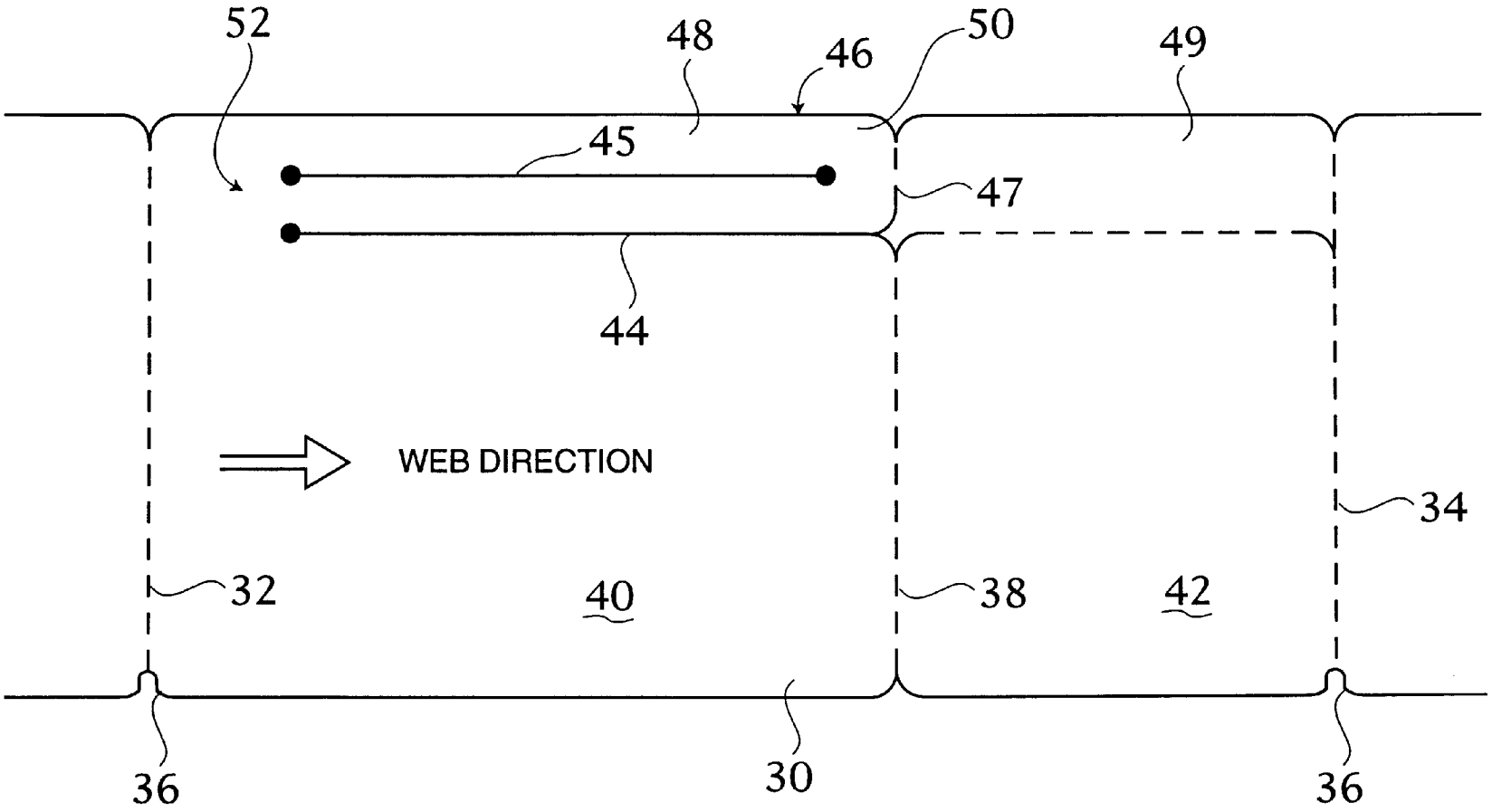
FIG. 2 is a plan view of the printable tag according to the presently preferred embodiment thereof.

Referring to FIG. 2, the printable tag comprises a diecut printable substrate 30 that defines an elongated web of material from which a plurality of tags are constructed. The presently preferred substrate is a biaxially multi-layered laminate of polyethylene. Suitable material can be obtained from Van Leer Flexible Packaging, Houston, Tex. The material is sold under the trade name Valeron. The multi-layered laminate is desired because it is virtually tear proof. The individual laminate layers are arranged so that the grain of one layer is orthogonal to the grain of the next layer. The presently preferred embodiment employs at least one matte finish top coating, to allow the tag to be printed on by thermal printing or laser printing means.

The substrate is perforated, as at 32 and 34, generally perpendicular to the longitudinal dimension of the substrate. Perforations 32 and 34 thus define the left and right side edges of a single tag. Direction of web travel has been indicated in FIG. 2.

Along one longitudinal edge of the tag are formed a series of media sensor notches 36. Preferably, these notches coincide with perforations 32 and 34 and are used by the media edge sensor 16 (FIG. 1) to notify the printing and dispensing mechanism where one tag ends and the next tag begins.

In addition to perforations 32 and 34, the substrate may optionally be provided with a perforation 38 that may be separated to subdivide the tag into a first tag body portion 40 and a second index card portion 42. The separable index card may be printed with information that corresponds to information printed on the tag body portion 40, thereby allowing an index card record to be made of articles that have been tagged using the printable tag of the invention.

The substrate 30 is provided with a pair of longitudinally extending perforations 44 and 45 that extend generally adjacent to first edge 46 of the substrate. An additional perforation 47 is formed in the substrate, joining perforation 44 such that when perforations 44 and 47 are separated a loop structure 48 is defined. The loop structure has a free end 50 and an attached end 52. Perforation 45 thus extends along the medial axis of the loop structure and may be separated to form an opening sized to allow the end of the tag to be passed through the opening during installation. If desired, additional perforations may be provided, as illustrated, to allow portion 49 to be removed and discarded.

OPERATION

Referring to FIGS. 3*a*–3*d*, printing 60 is applied to tag 10 using a suitable print engine such as the one illustrated in FIG. 1. Thereafter, perforation 38 (if provided) may be separated to remove the index card for suitable filing as at 62. Portion 49 may be removed and discarded. The index card feature is optional or not required in some applications. Perforation 44 is likewise separated to free the elongated strap 48.

Figure 3A:
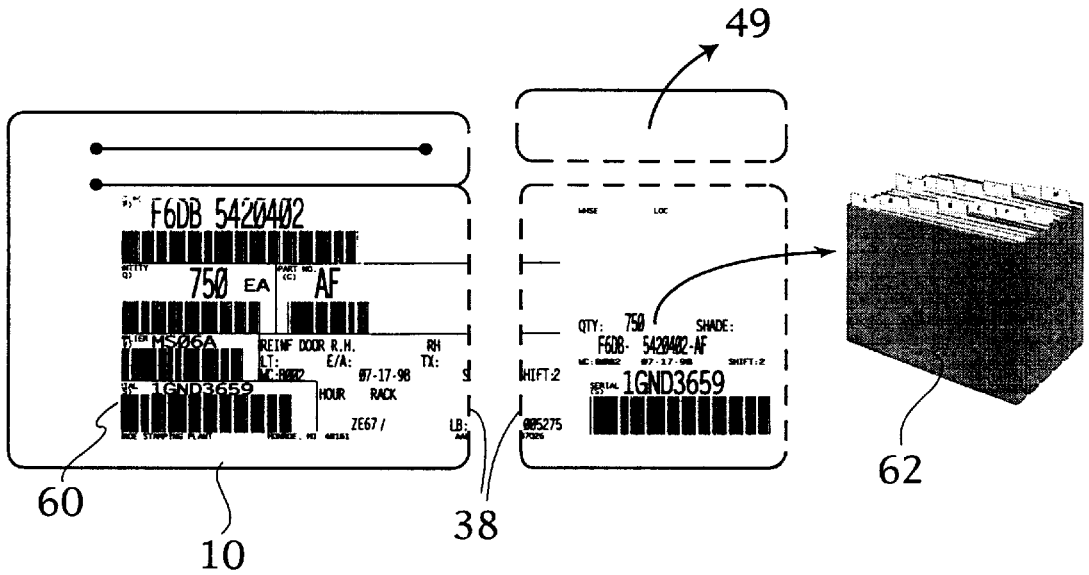
FIGS. 3*a*–3*d* illustrate the use of the tag.
Figure 3B:
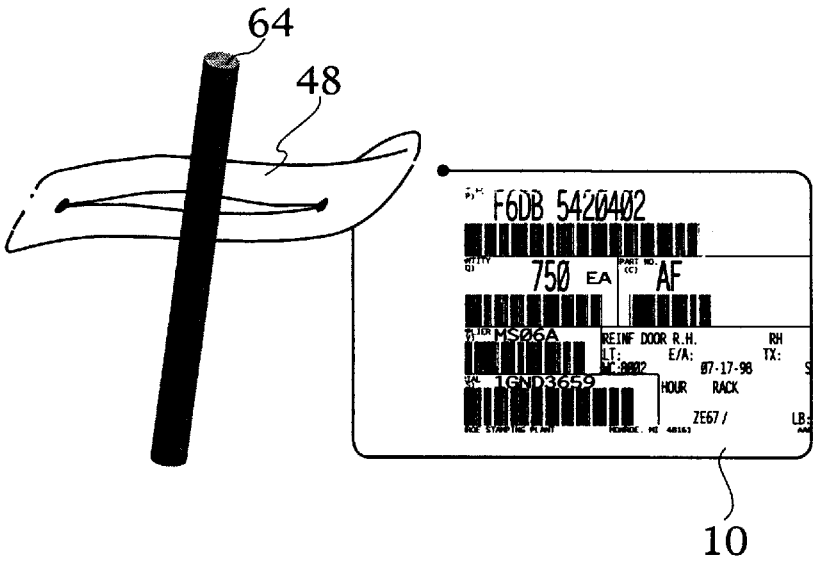
Figure 3C:
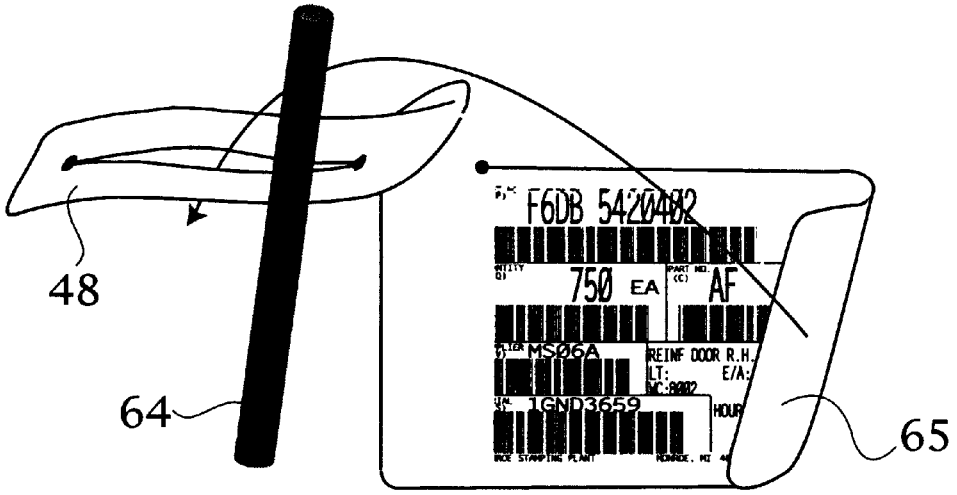
Figure 3D:
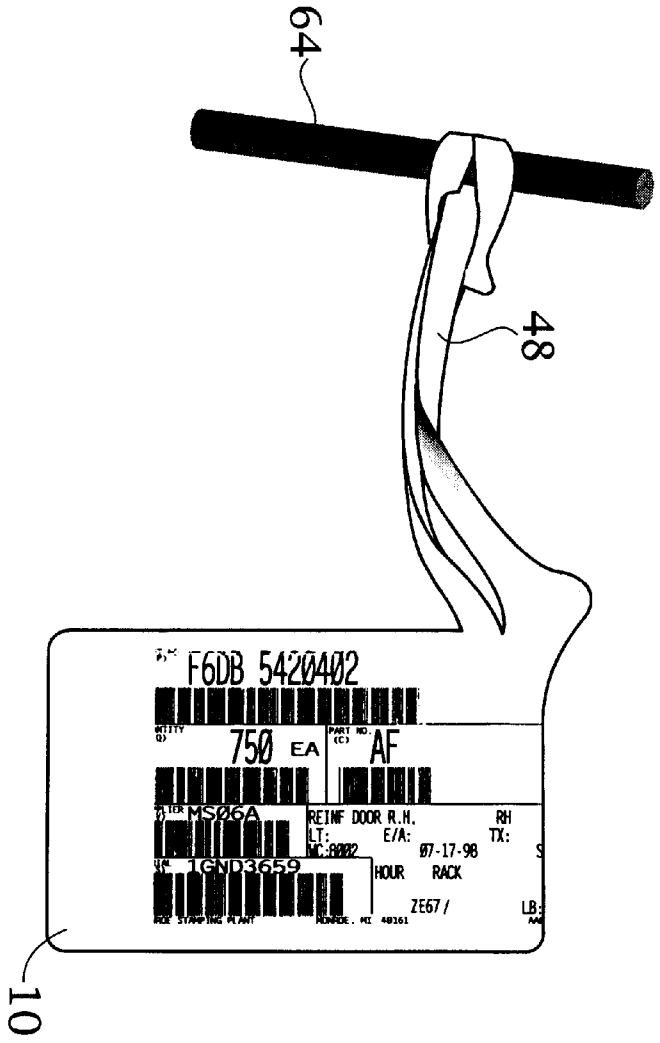

The loop structure 48 is then wrapped around the article to be tagged. In this case a vertical frame member of a wire basket 64 has been illustrated. The edge 65 of tag 10 is passed through the loop structure (i.e. through the opening defined by perforation 45) as shown in FIG. 3*c*. The tag is then pulled tight, causing the loop structure to form a knot around the article to which the tag is attached as shown in FIG. 3*d*.

While the invention has been described in its presently preferred form, it will be understood that certain modifications can be made to the printable tag without departing from the spirit of the invention as set forth in the appended claims.

We claim:

1. A printable tag with integral fastener, comprising:

a printable substrate defining a tag body having a first edge, a first perforation formed in said substrate extending laterally adjacent said first edge that separates to define a elongated loop structure; and a second perforation formed in said substrate extending laterally adjacent said first edge that separates to define an elongated slotted opening in said loop structure, said slotted opening being sized to allow said tag body to be passed through it.

2. The tag of claim 1 further comprising a third perforation in said substrate that separates to define a removable index card separate from said tag body.

3. The tag of claim 1 wherein said printable substrate carries printed information.

4. The tag of claim 2 wherein said printable substrate carries printed information on both said tag body and said index card.

5. The tag of claim 4 wherein said printed information is placed on said substrate prior to separation of said third perforation thereby ensuring that printed information on said index card corresponds to printed information on said printable tag.

6. The tag of claim 1 wherein said printable substrate is a polyethylene.

7. The tag of claim 1 further comprising a third perforation formed in said substrate that extends substantially perpendicular to said second perforation and that separates to define a removable index card separate from said printable tag.

8. The tag of claim 1 further comprising a third perforation formed in said substrate that defines a first edge of said printable tag substantially perpendicular to said loop structure.

9. The tag of claim 1 wherein said substrate comprise a machine feedable perforated web.

10. The tag of claim 1 wherein said printable substrate is a biaxially multilayered laminate.

* * * * *

UNITED STATES PATENT AND TRADEMARK OFFICE

CERTIFICATE OF CORRECTION

PATENT NO. : 6,116,653

DATED : September 12, 2000

INVENTOR(S) : John Carson Oberholzer et al.

It is certified that error appears in the above-identified patent and that said Letters Patent is hereby corrected as shown below:

Column 3, Claim 1, line 19, "a" should be --an--.

Column 4, Claim 6, line 12, after "polyethylene" insert --material--.

Column 4, Claim 9, line 22, "comprise" should be --comprises--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*